US011369223B2

(12) United States Patent
Plummer

(10) Patent No.: US 11,369,223 B2
(45) Date of Patent: Jun. 28, 2022

(54) ANTITHEFT PARCEL DELIVERY DOOR SYSTEM

(71) Applicant: GlassCraft Door Company, Houston, TX (US)

(72) Inventor: John Plummer, Houston, TX (US)

(73) Assignee: GLASSCRAFT DOOR COMPANY, Houston, TX (US)

( * ) Notice: Subject to any disclaimer, the term of this patent is extended or adjusted under 35 U.S.C. 154(b) by 0 days.

(21) Appl. No.: 17/119,492

(22) Filed: Dec. 11, 2020

(65) Prior Publication Data

US 2021/0177182 A1 Jun. 17, 2021

Related U.S. Application Data

(60) Provisional application No. 63/088,974, filed on Oct. 7, 2020, provisional application No. 62/947,174, filed on Dec. 12, 2019.

(51) Int. Cl.

| | |
|---|---|
| ***A47G 29/28*** | (2006.01) |
| ***A47G 29/14*** | (2006.01) |
| ***A47G 29/22*** | (2006.01) |

(52) U.S. Cl.

CPC ..... *A47G 29/28* (2013.01); *A47G 29/141* (2013.01); *A47G 29/22* (2013.01); *A47G 2029/149* (2013.01)

(58) Field of Classification Search

CPC ..... A47G 29/28; A47G 29/141; A47G 29/22; A47G 29/1254; A47G 29/20; A47G 2029/149; A47G 29/30; E05G 7/00; E05G 7/007; E06B 7/32; E06B 11/08

USPC ..... 232/19, 42, 43.4, 45; 49/68; 109/19, 67, 109/68

See application file for complete search history.

(56) References Cited

U.S. PATENT DOCUMENTS

| | | | | |
|---|---|---|---|---|
| 1,784,447 | A * | 12/1930 | Johnson | A47G 29/1209 232/49 |
| 3,519,198 | A * | 7/1970 | Benoliel | A47G 29/22 232/17 |
| 3,784,090 | A * | 1/1974 | Markham | G07D 11/0096 232/44 |
| 4,084,518 | A * | 4/1978 | Carlson | E06B 7/32 109/19 |
| 4,351,247 | A * | 9/1982 | Clark | E06B 7/32 109/11 |

(Continued)

*Primary Examiner* — William L Miller
(74) *Attorney, Agent, or Firm* — Nolte Lackenbach Siegel

(57) ABSTRACT

An antitheft parcel delivery door system for a facility including a door with a door opening; a weather resistant exterior cover attached to a first door face, moveably positioned over the opening; parcel drum support bracket, moveable arm and rotating parcel drum with parcel drum opening, and cam assembly revolving the rotating parcel drum in the door opening, the cam assembly rotating the parcel drum simultaneously while the weather resistant exterior cover is opened and closed, enabling the rotating parcel drum to receive a parcel then counter revolve in a second direction of rotation to deposit the parcel in a facility interior space; and a protective interior cover with opening attached to a second door face enabling a parcel to drop safely into the facility interior space while preventing unwanted facility access, theft of the parcel, human harm and animal harm from contact with the rotating parcel drum and the cam assembly.

17 Claims, 7 Drawing Sheets

(56) References Cited

U.S. PATENT DOCUMENTS

| | | | | |
|---|---|---|---|---|
| 6,748,879 | B2 * | 6/2004 | Ehrmann | G07F 11/24 109/13 |
| 7,428,980 | B2 * | 9/2008 | Irwin | E05G 7/001 232/45 |
| 7,896,226 | B1 * | 3/2011 | Branan | A47G 29/12095 232/45 |
| 9,926,737 | B2 * | 3/2018 | Wanjohi | A47G 29/126 |
| 10,697,237 | B1 * | 6/2020 | Carpenter | A47G 29/22 |
| 10,711,516 | B2 * | 7/2020 | Vanek | E06B 7/32 |
| 10,954,068 | B2 * | 3/2021 | Nevison | A47G 29/30 |
| 2002/0035857 | A1 * | 3/2002 | Stein | A47G 29/141 70/277 |
| 2012/0158606 | A1 * | 6/2012 | Moudy | G07F 9/001 705/332 |
| 2017/0213187 | A1 * | 7/2017 | Choi | A47G 29/141 |
| 2018/0228310 | A1 * | 8/2018 | Enobakhare | A47G 29/1207 |
| 2020/0071991 | A1 * | 3/2020 | Patel | E06B 7/28 |
| 2020/0308903 | A1 * | 10/2020 | Anderson | E05F 15/76 |
| 2021/0005033 | A1 * | 1/2021 | Roman | G07C 9/00896 |
| 2021/0230926 | A1 * | 7/2021 | Schler | G06Q 30/0601 |

* cited by examiner

ANTITHEFT PARCEL DELIVERY DOOR SYSTEM

CROSS-REFERENCE TO RELATED APPLICATION

This application claims priority to U.S. Provisional Patent Application No. 62/947,174 filed Dec. 12, 2019 and U.S. Provisional Patent Application No. 63/088,974 filed Oct. 7, 2020, the contents of which are incorporated herein by reference.

FIELD

The present embodiment generally relates to an antitheft parcel delivery door system for use in a facility.

BACKGROUND

A need exists for an antitheft parcel delivery door system to reduce theft of parcels from unattended porches, commercial front doorways, and other non-secure locations from which criminals can steal delivered parcels.

The present embodiments meet these needs.

BRIEF DESCRIPTION OF THE DRAWINGS

The detailed description will be better understood in conjunction with the accompanying drawings as follows.

Figure 1:
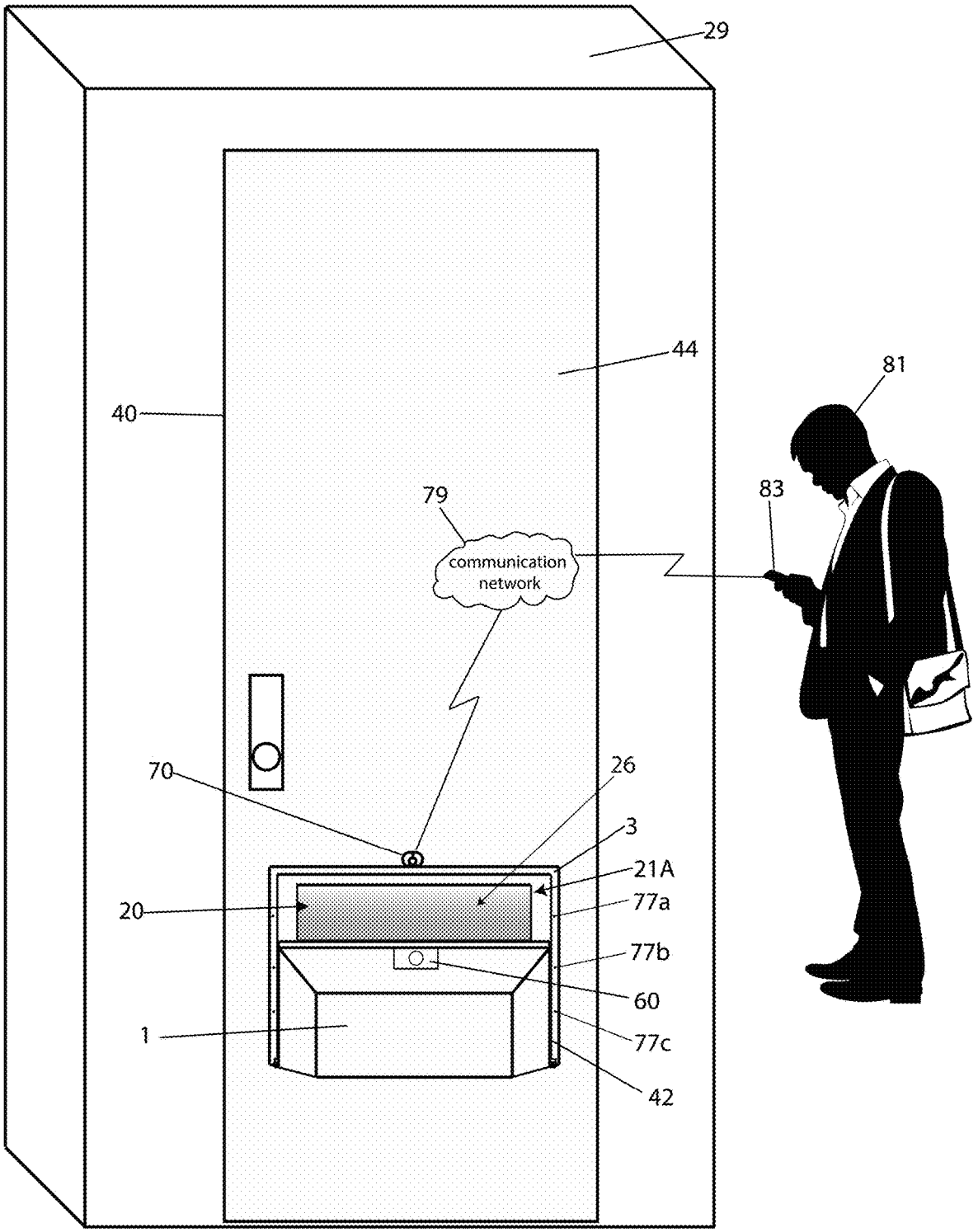
FIG. 1 is exterior view of an antitheft parcel delivery door system with weather resistant cover in the open, parcel receiving position.

The present embodiments are detailed below with reference to the listed Figures.

DETAILED DESCRIPTION

Before explaining the present system in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The following definitions are used herein:

The term "facility" refers to a factory, a residence, a commercial storefront, or a partial facility, and the like or to a box with 4 walls and top.

The term "facility interior space" refers to a portion of the facility which has controlled access from an exterior space, and which cannot be accessed freely without security from an exterior location.

The term "fastener" can refer to screws, bolts with nuts, or clamps and the like. In embodiments, "pivoting fasteners" can be hinges.

The term "parcel" as used herein may refer to one or more parcels and can include envelopes, bags, various shaped containers, boxes, letters including padded letters, fruit shipping bags, books, sports equipment, and similar items.

The invention relates to an antitheft parcel delivery door system for a facility.

The antitheft parcel delivery door system includes a door with a door opening; a weather resistant exterior cover attached to a first door face, moveably positioned over the door opening.

The antitheft parcel delivery door system includes a parcel drum support bracket, moveable arm, and rotating parcel drum with parcel drum opening, mounted within the door opening.

The antitheft parcel delivery door system can include a cam assembly configured for revolving the rotating parcel drum in the door opening. The cam assembly rotates the parcel drum simultaneously while the weather resistant exterior cover is opened and closed, enabling the rotating parcel drum to revolve in a first direction to receive a parcel then counter revolve in a second direction of rotation to deposit the parcel in a facility interior space.

The antitheft parcel delivery door system includes a protective interior cover with opening attached to a second door face enabling a parcel to drop safely into the facility interior space while preventing unwanted facility access, theft of the parcel, human harm and animal harm from contact with the rotating parcel drum and the cam assembly.

EXAMPLE

The following is an example of a particular antitheft parcel delivery door system has a door that can be made of fiberglass and steel composite and have a dimension of 80 inches high and 36 inches wide, and with a 1.75 inch thickness.

The door has a door opening extending from a first door face that is a simulated wood skin on the exterior through to a second door face which is a simulated wood skin on an interior side.

The door is secured to a facility, which for this Example, is a single family home.

The door opening in this Example, is 18 inches high and 30 inches wide and extends through the door forming a hole.

A weather resistant exterior cover is attached to a flange with a pivoting fasteners, which in this Example, is a hinge.

The weather resistant exterior cover, of this Example, is made of polymer coated metal and is movably positioned over a flange and door opening combination.

The weather resistant exterior cover, of this Example, is at 1 inch larger in each dimension (width and height) than the door opening.

The flange is positioned in the door opening. The flange can have the same shape as the door opening.

The flange can have a width that is 1 inch larger than the width of the opening and 1 inch larger than the height of the opening. The flange of this example can be made from fiberglass and fit snugly in the opening.

A gasket can be installed between the flange and the door opening to additionally weatherproof the antitheft parcel delivery door system. The gasket can be made from silicon or butyl rubber for this Example.

The gasket can be flat and have the same shape as the flange surrounding the door opening.

Fasteners attach the flange to a parcel drum support bracket passing through the door.

The fasteners can be screws or bolts with nuts. Between 2 fasteners to 20 fasteners can be used per flange.

The fasteners extend through the door to the flange and support bracket.

A moveable arm is attached on one end to the weather resistant exterior cover. The moveable arm can be a pair of pneumatic struts, in this Example.

A rotating parcel drum with a first side and a second side and parcel drum opening formed in an outer drum surface positioned between the first side and the second side is attached to a cam assembly that is attached to the moveable arm.

In this Example, the rotating parcel drum has a longitudinal dimension (that is, a length) that is 1 inch smaller than a width of the door opening and the rotating parcel drum can have a diameter that is 1 inch smaller than the height of the door opening.

In this Example the rotating parcel drum can have a diameter of 12 inches.

The cam assembly of this Example, is configured for operating by revolving, the rotating parcel drum, while the weather resistant cover is sequentially opened from a closed position and then closed.

When the weather resistant exterior cover is pulled away from the door, which, in the Example, the weather resistant exterior cover can be pulled 12 inches from the door while hinged on an exterior surface of the door, to a parcel receiving position (open), the cam assembly simultaneously revolves the rotating parcel drum in a first direction of rotation enabling the rotating parcel drum to provide its opening toward the exterior side of the door, enabling the rotating parcel drum to receive a parcel inside the rotating parcel drum. The parcel of this Example can be a 50 pound bag of dog food.

As the weather resistant cover is then moved to a closed position from the open position, the cam assembly then counter revolves the rotating drum assembly in a second direction of rotation as the weather resistant exterior cover is simultaneously closed enabling the parcel of dog food to be deposited from the rotating parcel drum interior into a facility interior space of the home which is secure from thieves.

Inside the home, and secured to the door on the second (interior facing) door face a protective interior cover is mounted.

The protective interior cover has a protective interior cover opening that is large enough to allow the dog food bag to drop from inside the rotating drum assembly to the floor of the home on the interior of the home, without breaking the bag of dog food scattering food bits everywhere.

In this Example, the antitheft parcel delivery door system prevents unwanted facility access, such as from a burglar.

In this Example, the antitheft parcel delivery door system prevents theft of the delivered dog food parcel from the home's front porch.

In this Example, the antitheft parcel delivery door system prevents human harm such as harm to children's fingers from contacting with the rotating parcel drum and the cam assembly because the protective covers and the mounting system do not provide small children with access to the moving parts.

In this Example, the antitheft parcel delivery door system prevents the family pet from injury due to the pet's attempting to pass through the door opening, which is safely prevented by the antitheft parcel delivery door system.

The antitheft parcel delivery door system includes, in an embodiment, a plurality of fasteners securing the weather resistant exterior cover on one side of the door.

In an embodiment, the antitheft parcel delivery door system includes: a pair of parcel drum support brackets mounted to the door on opposite sides of the door opening.

The antitheft parcel delivery door system includes, in an embodiment, the moveable arm the moveable arm is a plurality of telescoping struts, wherein one of the telescoping struts is attached to weather resistant exterior cover at a first position and the other telescoping strut is attached to the weather resistant exterior cover at a second position in a spaced apart relationship to the first telescoping strut.

In an embodiment, when the antitheft parcel delivery door system includes a moveable arm with telescoping struts, the telescoping struts are selected from the group: pneumatic struts, hydraulic struts, a spring, and mechanically operable struts.

The antitheft parcel delivery door system includes, in an embodiment, a cam assembly with a cam actuating arm attached to the moveable arm, a cam actuator attached to the cam actuating arm, and a cam hub attached to the cam actuating arm.

In an embodiment, the antitheft parcel delivery door system includes in the rotating parcel drum: a drum opening with a first edge and second edge cut across a radius R of the parcel drum between the first and second sides of the rotating parcel drum, the drum opening formed at an angle from 35 degrees to 170 degrees from a longitudinal axis of the rotating parcel drum.

The antitheft parcel delivery door system includes an embodiment utilizing a plurality of fasteners to affix the protective interior cover to the second door face.

In an embodiment, the antitheft parcel delivery door system has a protective interior cover with a first cover side, a second cover side and a cowling supported between the first and second cover sides.

In an embodiment of the antitheft parcel delivery door system, the door, the weather resistant exterior cover, the rotating parcel drum and the protective interior cover can comprise a member of the group consisting of: a metal; fiberglass; a polymer; a wood; or a composite of metal, fiberglass, a polymer; and combinations thereof.

The antitheft parcel delivery door system includes in an embodiment: a rotating parcel drum with a radius from 5 inches to 36 inches and a length along a longitudinal axis of the rotating parcel drum from 10 inches to 40 inches.

In an embodiment, the antitheft parcel delivery door system includes a cam assembly for revolving the rotating parcel drum to receive and deposit parcels at a rate of one parcel every 2 seconds to 2 minutes.

In an embodiment, the antitheft parcel delivery door system includes a camera, which can be wirelessly or Bluetooth™ connected to a network, such as a global communication network, for recording delivery personnel, parcels, and notifying a client device of a parcel owner, which can be a cellular device such as a cell phone, of delivery of a parcel.

In an embodiment, the antitheft parcel delivery door system has a rotating parcel drum configured to support multiple parcels with a combined weight from 0.5 pounds to 60 pounds.

In an embodiment, the antitheft parcel delivery door system utilizes a flange positioned in the door opening, and wherein the flange is the same shape as the door opening.

In an embodiment of the antitheft parcel delivery door system, a gasket can be installed between the flange and the door opening, and the gasket can be made of a silicon or a butyl rubber.

In an embodiment, fasteners can be used for securing the flange to a parcel drum support bracket. It is contemplated that between 2 fasteners to 20 fasteners can be used per flange.

Yet another embodiment contemplates a motorized antitheft parcel delivery door system having a door with a door opening extending from a first door face through to a second door face, wherein the door is mounted to a facility.

In this embodiment, a weather resistant exterior cover is movably positioned over the door opening secured to the first door face.

In this same embodiment, a parcel drum support bracket is mounted to the door in the door opening.

In this same embodiment, a moveable arm is attached on one end to the weather resistant exterior cover.

In this same embodiment, a rotating parcel drum is used which has a first side, a second side an outer drum surface and a parcel drum opening formed through an outer drum surface between the first side and the second side.

In this same embodiment, a motor with a power source revolves the rotating parcel drum a first direction of rotation from a weather resistant position to a parcel receiving position when the weather resistant exterior cover is moved.

In this same embodiment, the motor revolves the rotating parcel drum to receive a parcel then counter revolves the rotating parcel drum in a second direction of rotation enabling the parcel to be deposited in a facility interior space.

This same embodiment includes a protective interior cover with a protective interior cover opening attached to the second door face to enable a parcel to be delivered to a facility and drop safely into the facility interior space while preventing (i) unwanted facility access, (ii) theft of the parcel, (iii) human harm from contact with the rotating parcel drum and the motor and/or (iv) animal harm from contact with the rotating parcel drum and motor through the weather resistant opening.

Turning now to the Figures, FIG. 1 is exterior view of an antitheft parcel delivery door system with weather resistant cover in the open, parcel receiving position.

A door 40 is depicted with a door opening 42 extending from a first door face 44 (exterior) through to a second door face (interior) not shown in this FIG. 1.

The door 40 is secured to a facility 29.

A weather resistant exterior cover 1 is depicted as it is movably positioned over the door opening 42 and secured to the first door face 44.

A flange 3 is depicted positioned in the door opening, and wherein the flange is the same shape as the door opening.

A rotating parcel drum 20 is shown.

The outer drum surface 26 is shown which is positioned between the first side and the second side.

A weather resistant exterior cover latch 60 can keep the cover closed.

The antitheft parcel delivery door system is shown with a camera 70 connected to a network 79 for recording delivery personnel, parcels, and notifying a client device 83 of a parcel owner 81 of delivery of the parcel which is not shown in this FIG. 1.

FIG. 1 also shows a trio fasteners 77*a*, 77*b*, 77*c* securing the flange 3 on one side of the door 40. Note that other fasteners (not indicated) are also included about the periphery of the flange 3.

Figure 2:
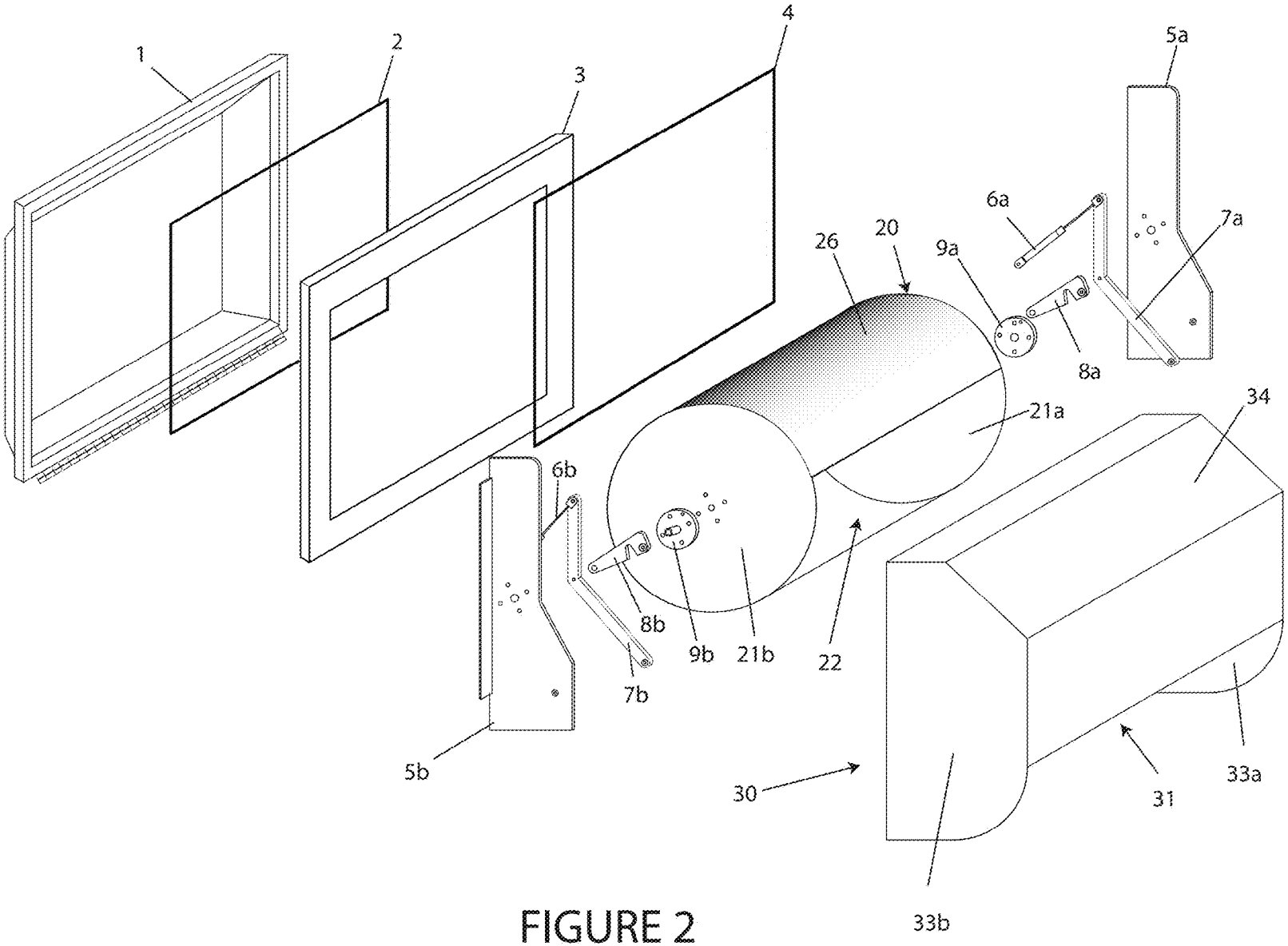
FIG. 2 is an exploded view of a weather resistant exterior cover, parcel drum support bracket, a moveable arm, a rotating parcel drum, a cam assembly and a protective interior cover.

FIG. 2 is an exploded view of a weather resistant exterior cover, parcel drum support bracket, a moveable arm, a rotating parcel drum, a cam assembly and a protective interior cover.

A weather resistant exterior cover 1 is shown.

A gasket 2 is installed between a flange 3 and the weather resistant exterior cover 1.

Another gasket, a flange gasket 4 is shown adjacent the flange 3.

A parcel drum support bracket 5*a* is shown for mounting to the door in the door opening.

A moveable arm 6*a* is shown which attaches on one end to the weather resistant exterior cover 1 and on the other end to a cam actuating arm 7*a*.

A cam actuator 8*a* also attaches to the cam actuating arm 7*a*, and a cam hub 9*a* attaches to the cam actuating arm.

A rotating parcel drum 20 with a first side 21*a* and a second side 21*b* and an outer drum surface 26 is shown. A parcel drum opening 22 is formed through an outer drum surface 26 between the first side and the second side.

A parcel drum support bracket 5*b* is shown for mounting to the door in the door opening.

In this FIG. 2, a second moveable arm 6*b* is shown which attaches on one end to the weather resistant exterior cover 1.

A second cam actuating arm 7*b* attaches to the second moveable arm, a second cam actuator 8*b* attaches to the second cam actuating arm 7*b*, and a second cam hub 9*b* attached to the second cam actuating arm.

A protective interior cover 30 with a protective interior cover opening 31 is shown.

The protective interior cover has a first cover side 33*a*, a second cover side 33*b* and a cowling 34 supported between the first and second cover sides of the protective interior cover.

Figure 3:
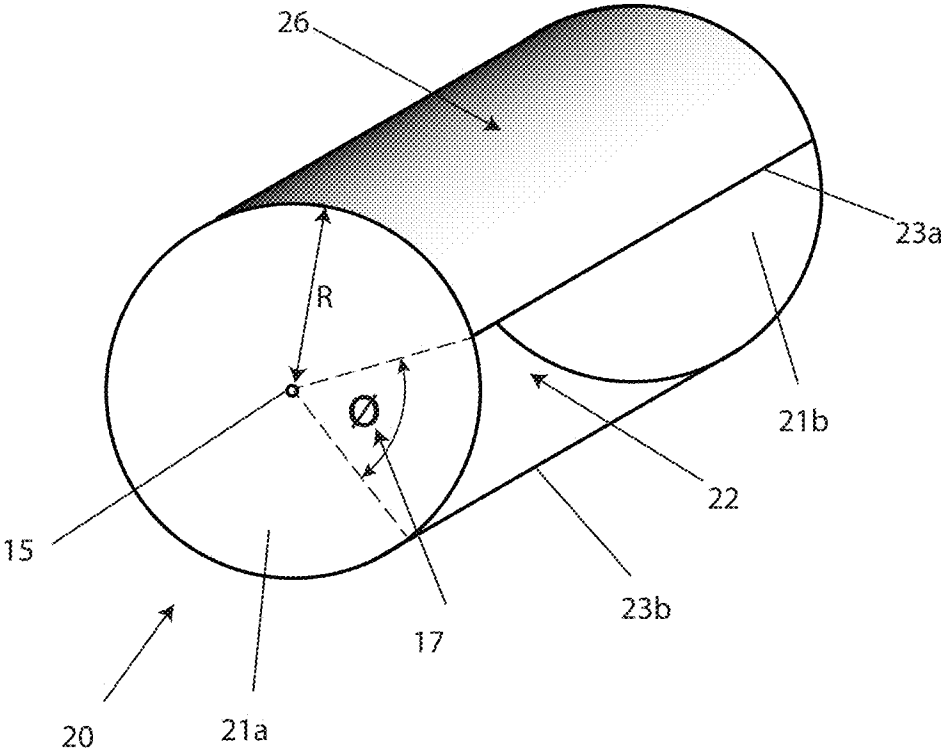
FIG. 3 is a detailed view of rotating parcel drum with parcel drum opening.

FIG. 3 is a detailed view of rotating parcel drum with parcel drum opening.

FIG. 3 shows a rotating parcel drum 20 with a drum opening 22 with a first edge 23*a* and second edge 23*b* cut across a radius R of the parcel drum 20 between the first and second sides 21*a*, 21*b* of the rotating parcel drum.

FIG. 3 shows the drum opening formed at an angle 17 from 35 degrees to 170 degrees from a longitudinal axis 15 of the rotating parcel drum.

The outer drum surface 26 is also depicted.

Figure 4:
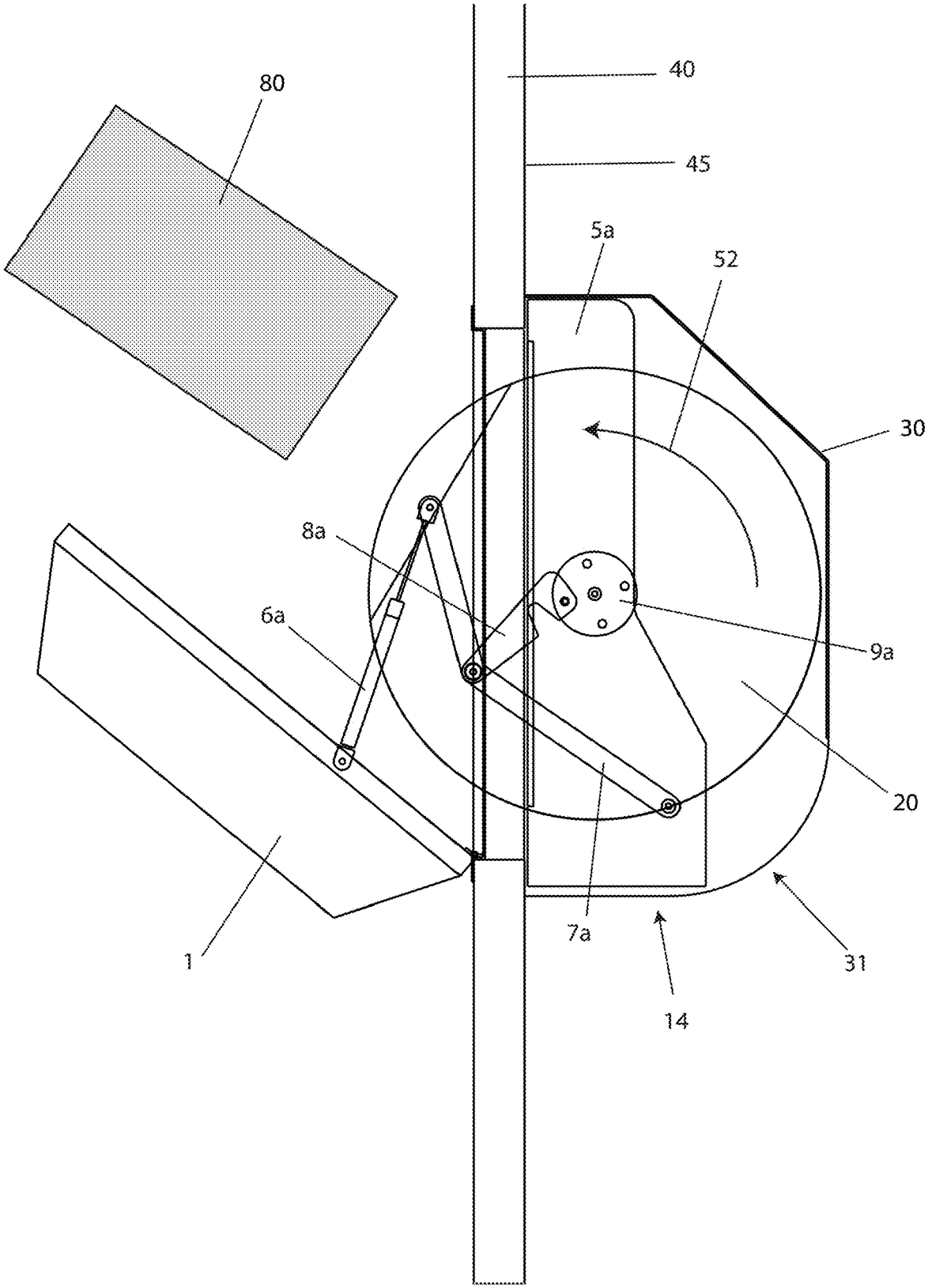
FIG. 4 is a side view with the antitheft parcel delivery door system in the parcel receiving position and details of the cam assembly.

FIG. 4 is a side view with the antitheft parcel delivery door system in the parcel receiving position and details of the cam assembly.

Cam assembly 14 is shown with the weather resistant exterior cover 1 in the open position with parcel 80.

FIG. 4 shows protective interior cover 30 with a protective interior cover opening 31 attached to the second door face 45 of a door 40 to enable a parcel 80 to be delivered to a facility.

The cam assembly 14 simultaneously revolves the rotating parcel drum 20 while the weather resistant exterior cover 1 is opened or closed.

The cam assembly 14 is configured to revolve the rotating parcel drum in a first direction of rotation 52 from a weather resistant position to a parcel receiving position enabling the rotating parcel drum to receive the parcel 80 then counter revolve in a second direction of rotation 54 (shown in FIG.

5) from the parcel receiving position to the weather resistant position enabling the parcel 80 to be deposited in a facility interior space.

The cam assembly 14 is attached between a side 21*a* of the rotating parcel drum 20 and the parcel drum support bracket 5*a*. A cam actuating arm 7*a* is shown attached to a moveable arm 6*a*, a cam actuator 8*a* attached to the cam actuating arm 7*a*. A cam hub 9*a* is shown attached to the cam actuating arm.

A parcel drum support bracket 5*a* is shown.

Figure 5:
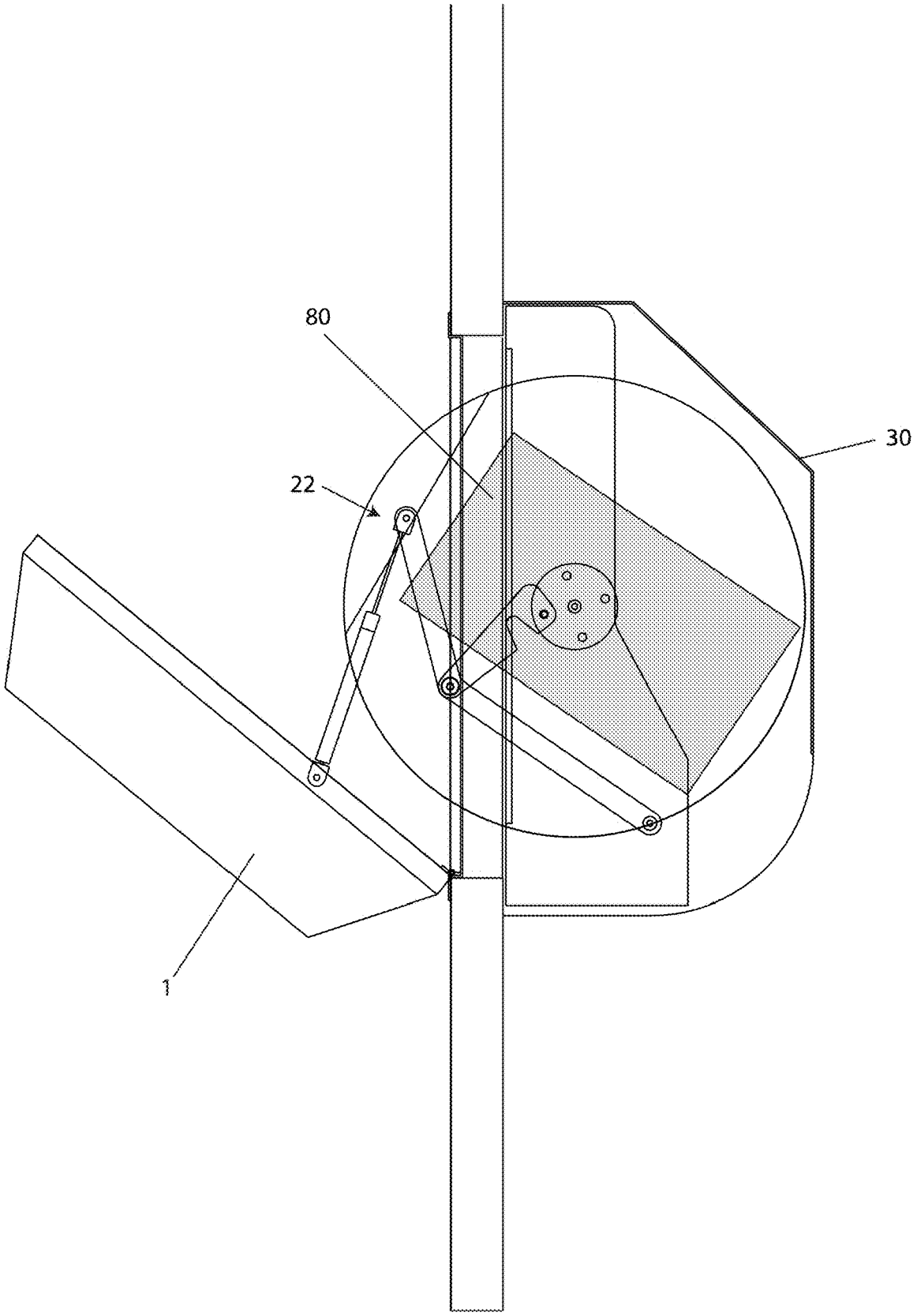
FIG. 5 is a side view with the antitheft parcel delivery door system containing a parcel.

FIG. 5 is a side view with the antitheft parcel delivery door system containing a parcel.

Parcel 80 is shown.

A weather resistant exterior cover 1 is shown.

A protective interior cover 30 with a protective interior cover opening is shown.

The rotating parcel drum opening 22 is shown in FIG. 5 with the weather resistant exterior cover in the open position with the rotating parcel drum containing the parcel.

Figure 6:
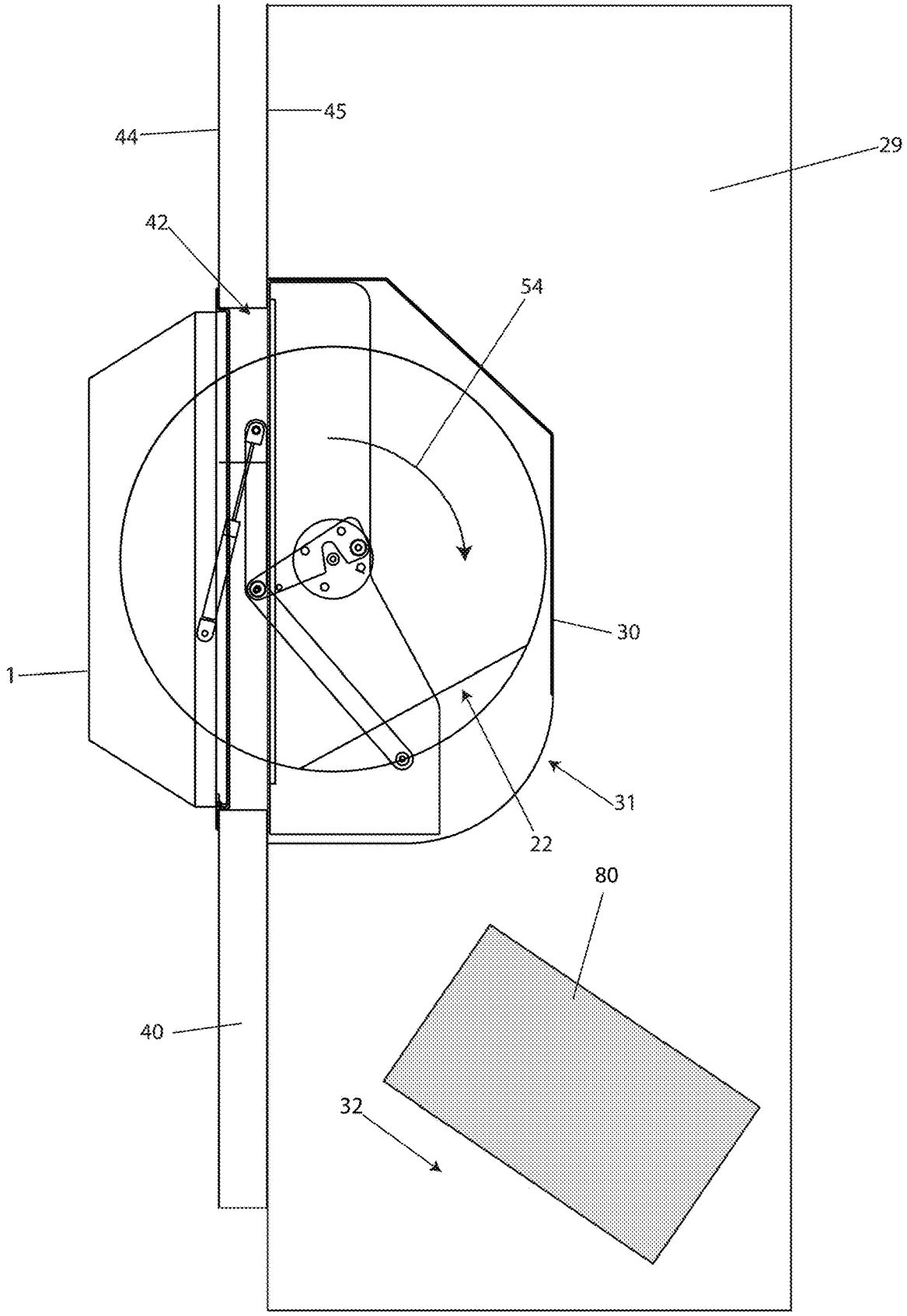
FIG. 6 is a side view with the antitheft parcel delivery door system in the weather resistant position with parcel deposited in the interior facility space.

FIG. 6 is a side view with the antitheft parcel delivery door system in the weather resistant position with parcel deposited in the interior facility space.

A door 40 with a door opening 42 is shown extending from a first door face 44 (exterior) through to a second door face 45 (interior).

A weather resistant exterior cover 1 is movably positioned over the door opening 42 secured to the first door face 44.

A protective interior cover 30 is shown with a protective interior cover opening 31. The protective interior cover 30 is shown attached to the second door face 45 enabling a parcel 80 to drop safely into the facility interior space 32 of the facility 29.

The cam assembly 14 is configured to revolve the rotating parcel drum in a first direction of rotation 52 (shown in FIG. 4) from a weather resistant position to a parcel receiving position enabling the rotating parcel drum to receive a parcel 80 then counter revolve in a second direction of rotation 54 (shown in FIG. 6) from the parcel receiving position to the weather resistant position enabling the parcel 80 to be deposited in a facility interior space 32.

Figure 7:
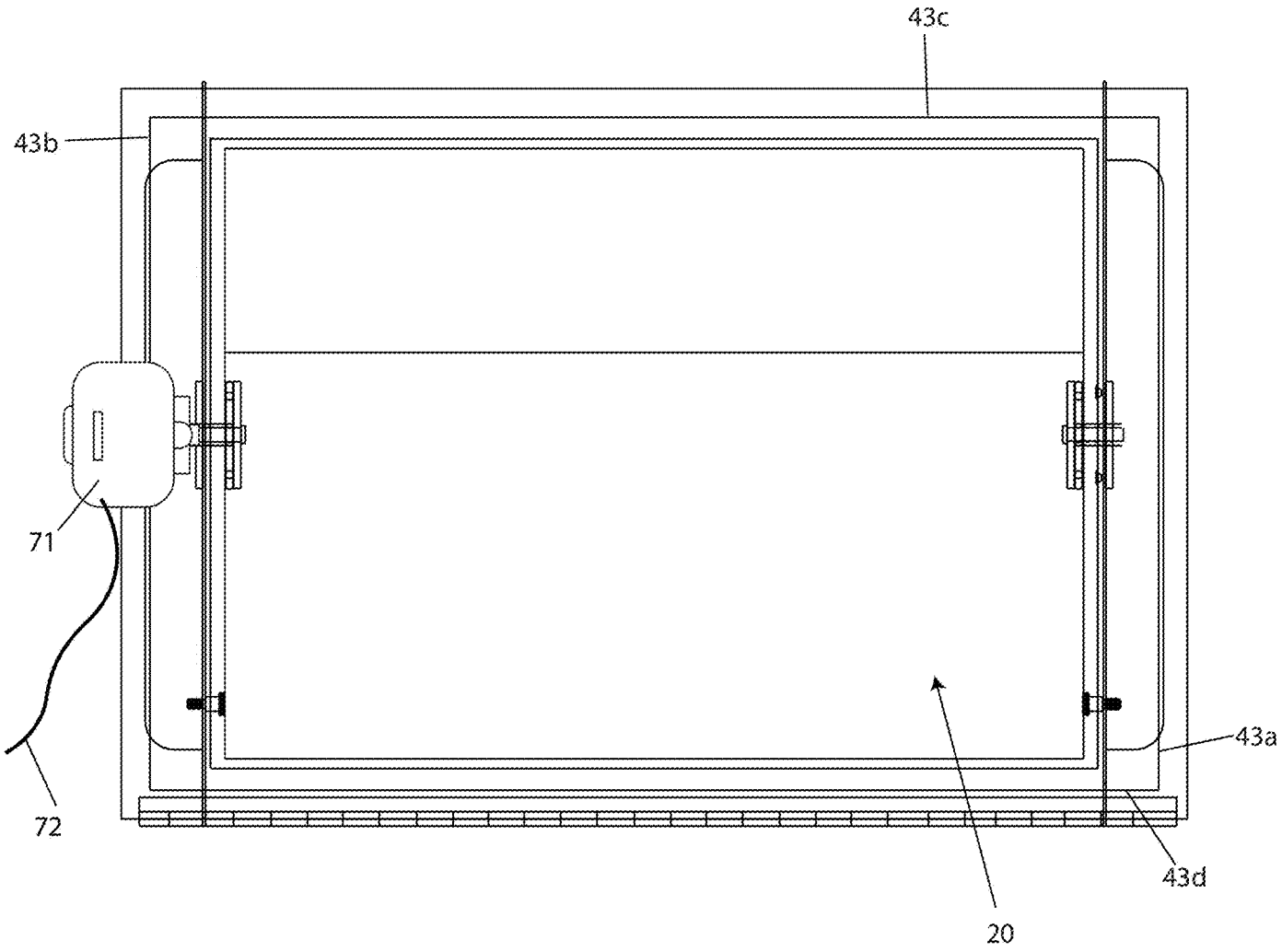
FIG. 7 is a cross sectional interior view of the motorized antitheft parcel delivery door system.

FIG. 7 is a cross sectional interior view of a motorized antitheft parcel delivery door system.

A rotating parcel drum 20 and a motor 71 with a power source 72 revolving a rotating parcel drum when the weather resistant exterior cover is moved in a first direction of rotation from a weather resistant position to a parcel receiving position, the motor revolving the rotating parcel drum to receive a parcel then counter revolving the rotating parcel drum in a second direction of rotation to the weather resistant position enabling the parcel 80 to be deposited in a facility interior space. The motor may, in some examples, be actuated by opening the weather resistant exterior cover.

FIG. 7 shows the first door opening side 43*a*, second door opening side 43*b*, third door opening side 43*c*, and a fourth door opening side 43*d*.

While these embodiments have been described with emphasis on the embodiments, it should be understood that within the scope of the appended claims, the embodiments might be practiced other than as specifically described herein.

What is claimed is:

1. An antitheft parcel delivery door system comprising:

a door with a door opening extending from a first door face through to a second door face secured to a facility;

a weather resistant exterior cover movably positioned over the door opening and secured to the first door face;

a parcel drum support bracket mounted to the door in the door opening;

a moveable arm attached on one end to the weather resistant exterior cover;

a rotating parcel drum with a first side and a second side and parcel drum opening formed in an outer drum surface of the rotating parcel drum between the first side and the second side of the rotating parcel drum;

a cam assembly attached to another end of the movable arm configured to revolve the rotating parcel drum simultaneously while the weather resistant exterior cover is opened and closed, the cam assembly configured to revolve the rotating parcel drum in a first direction of rotation from a weather resistant position to a parcel receiving position enabling the rotating parcel drum to receive a parcel then counter revolve in a second direction of rotation from the parcel receiving position to the weather resistant position enabling the parcel to be deposited in a facility interior space, the cam assembly attached between a first side of the rotating parcel drum and the parcel drum support bracket; and a protective interior cover with a protective interior cover opening attached to the second door face to enable the parcel to be delivered to the facility and drop safely into the facility interior space while preventing at least a member of the group consisting of: (i) unwanted facility access, (ii) theft of the parcel, (iii) human harm from contact with the rotating parcel drum and the cam assembly and (iv) animal harm from contact with the rotating parcel drum and cam assembly through the door opening.

2. The antitheft parcel delivery door system of claim 1, further comprising: a plurality of fasteners securing the weather resistant exterior cover on the first door face.

3. The antitheft parcel delivery door system of claim 1, further comprising: a pair of the parcel drum support brackets mounted to the door on opposite sides of the door opening.

4. The antitheft parcel delivery door system of claim 1, wherein the moveable arm comprises: a plurality of telescoping struts, wherein one of the telescoping struts is attached to weather resistant exterior cover at a first position and the other telescoping strut is attached to the weather resistant exterior cover at a second position in a spaced apart relationship to the first telescoping strut.

5. The antitheft parcel delivery door system of claim 4, wherein the telescoping struts are struts selected from the group comprising: pneumatic struts, hydraulic struts, a spring, and mechanically operable struts.

6. The antitheft parcel delivery door system of claim 1, wherein the cam assembly comprises: a cam actuating arm attached to the moveable arm, a cam actuator attached to the cam actuating arm, and a cam hub attached to the cam actuating arm.

7. The antitheft parcel delivery door system of claim 1, comprising in the rotating parcel drum: the drum opening with a first edge and second edge cut across a radius R of the parcel drum between the first and second sides of the rotating parcel drum, the drum opening formed at an angle from 35 degrees to 170 degrees from a longitudinal axis of the rotating parcel drum.

8. The antitheft parcel delivery door system of claim 1, comprising: a first cover side, a second cover side and a cowling supported between the first and second cover sides of the protective interior cover.

9. The antitheft parcel delivery door system of claim 1, wherein the door, the weather resistant exterior cover, the rotating parcel drum and the protective interior cover comprise a member of the group consisting of: a metal; fiberglass; a polymer; a wood; a composite of metal, fiberglass, a polymer; and combinations thereof.

10. The antitheft parcel delivery door system of claim 1, comprising: the rotating parcel drum with a radius R from 5 inches to 36 inches and a length along a longitudinal axis of the rotating parcel drum from 10 inches to 40 inches.

11. The antitheft parcel delivery door system of claim 1, comprising: the cam assembly for revolving the rotating parcel drum to receive and deposit parcels at a rate of one every 2 seconds to 2 minutes.

12. The antitheft parcel delivery door system of claim 1, comprising: a camera connected to a network for recording delivery personnel, parcels, and notifying a client device of a parcel owner of delivery of the parcel.

13. The antitheft parcel delivery door system of claim 1, wherein the rotating parcel drum is configured to support multiple parcels with a combined weight from 0.5 pounds to 60 pounds.

14. The antitheft parcel delivery door system of claim 1, comprising a flange is positioned in the door opening, and wherein the flange is the same shape as the door opening.

15. The antitheft parcel delivery door system of claim 14, comprising a gasket installed between the flange and the door opening, and wherein the gasket comprises: a silicon or a butyl rubber.

16. The antitheft parcel delivery door system of claim 15, comprising 2 fasteners to 20 fasteners used per flange.

17. A motorized antitheft parcel delivery door system comprising:

a door with a door opening extending from a first door face through to a second door face, wherein the door is mounted to a facility;

a weather resistant exterior cover movably positioned over the door opening secured to the first door face;

a parcel drum support bracket mounted to the door in the door opening;

a moveable arm attached on one end to the weather resistant exterior cover;

a rotating parcel drum with a first side and a second side and parcel drum opening formed through an outer drum surface between the first side and the second side;

a motor with a power source revolving the rotating parcel drum when the weather resistant exterior cover is moved in a first direction of rotation from a weather resistant position to a parcel receiving position, the motor revolving the rotating parcel drum to receive a parcel then counter revolving the rotating parcel drum in a second direction of rotation to the weather resistant position enabling the parcel to be deposited in a facility interior space; and a protective interior cover with a protective interior cover opening attached to the second door face to enable the parcel to be delivered to the facility and drop safely into the facility interior space while preventing at least a member of the group comprising: (i) unwanted facility access, (ii) theft of the parcel, (iii) human harm from contact with the rotating parcel drum and the motor and (iv) animal harm from contact with the rotating parcel drum and motor through the door opening.

* * * * *